United States Patent [19]

Bleich et al.

[11] Patent Number: 4,877,645

[45] Date of Patent: Oct. 31, 1989

[54] METHODS OF AND APPARATUS FOR APPLYING A COATING MATERIAL TO ELONGATED MATERIAL

[75] Inventors: Larry L. Bleich, Omaha, Nebr.; Joni A. Roberts, Stone Mountain, Ga.; Stephen T. Zerbs, Gretna, Nebr.

[73] Assignee: American Telephone & Telegraph AT&T Technologies, Inc., Berkeley Heights, N.J.

[21] Appl. No.: 160,891

[22] Filed: Feb. 26, 1988

[51] Int. Cl.[4] ..... B05D 5/06; B05D 7/00

[52] U.S. Cl. ..... 427/117; 427/424; 118/314; 118/315; 118/326; 118/DIG. 22

[58] Field of Search ..... 118/316, 325, DIG. 22, 118/314, 315, 326, 302; 427/424, 117

[56] References Cited

U.S. PATENT DOCUMENTS

| | | | |
|---|---|---|---|
| 1,718,556 | 6/1929 | Harrison . | |
| 2,939,904 | 6/1960 | Ingmanson et al. | 174/69 |
| 2,981,225 | 4/1961 | Vatt et al. | 118/325 X |
| 3,155,545 | 11/1964 | Rocks et al. | 118/316 X |
| 3,176,650 | 4/1965 | Woellner | 178/314 |
| 3,220,379 | 11/1965 | Wallis | 118/DIG. 4 |
| 3,383,054 | 5/1968 | Nugarus | 239/597 |
| 3,407,099 | 10/1968 | Schell | 148/153 |
| 3,413,956 | 12/1968 | Woellner | 118/314 |
| 3,663,359 | 5/1972 | Braim | 162/105 |
| 4,161,564 | 7/1979 | Legbandt | 428/381 |
| 4,387,665 | 6/1983 | Clinton | 118/674 |

FOREIGN PATENT DOCUMENTS

| | | |
|---|---|---|
| 349092 | 6/1977 | Austria . |
| 2825645 | 6/1978 | Fed. Rep. of Germany . |

OTHER PUBLICATIONS

Medek and Schorner Brochure.

Spraying System Company, Wheaton, Ill., 3 Brochure pages.

*Primary Examiner*—Shrive Beck

*Assistant Examiner*—Alain Bashore

*Attorney, Agent, or Firm*—Edward W. Somers

[57] ABSTRACT

Methods and apparatus are provided for applying a colorant material to the surface of a plastic insulation material which has been applied to an elongated material such as a metallic conductor (22) or an optical fiber which is being moved at any of a wide range of speeds along a path of travel. The colorant material is applied by nozzles which are staggered along the path of travel and which direct the colorant into engagement with the plastic insulation material at different radial directions. A first plurality of nozzles (46—46) each cause the colorant to be in a spray pattern (45) which is in the area of a plane. Advantageously, those nozzles cooperate to stabilize the conductor and prevent undulations thereof as the conductor is moved along its path of travel. A second plurality of nozzles (50—50) cause the colorant to be in a solid conical pattern (53). The first and the second pluralities of nozzles are effective to cause substantially all the surface area of the plastic insulation on successive increments of length of the conductor to be covered with the colorant material.

13 Claims, 6 Drawing Sheets

METHODS OF AND APPARATUS FOR APPLYING A COATING MATERIAL TO ELONGATED MATERIAL

TECHNICAL FIELD

This invention relates to methods of and apparatus for applying a coating material to elongated material. More particularly, it relates to methods of and apparatus for applying a colorant material to plastic insulation for the purpose of identification after the insulation has been applied to media means.

BACKGROUND OF THE INVENTION

Plastic insulated wire for communications use, for example, generally is made by extruding plastic insulation about a moving wire. For identification purposes during use of the insulated wire, the insulation extrudate generally includes a colorant. In order to change colors, the extruding equipment has to be purged prior to its use with a plastic material having a different colorant. Obviously, this requires much time and wastes much material. Furthermore, colorant materials used for such purpose generally are metallic based materials which results in an increased number of faults in the final product.

It would be far simpler if all the manufactured wire could be made with a neutral insulation material such as a clear plastic, for example, and then colored subsequently. The changeover of colors in a marking apparatus, positioned after an extruder along a manufacturing line, is far less costly than changeover in the extruder and results in improved quality and performance.

The application of a colorant material to a moving wire may be accomplished in any of several ways. For example, it could be applied by a contact device such as a wheel or it could be applied in a spray or stream by a nozzle.

In the art of applying bands of different colors onto insulated wire, it is known to employ apparatus including a pair of hollow discs mounted on opposite sides of a wire advancing longitudinally along a predetermined path. Each of the discs is provided with a peripheral row of spaced radially directed apertures and colored fluid or ink, which is supplied to the discs, is forced outwardly through the apertures in the form of streams as the discs rotate. Streams of ink from one disc of the pair engage the advancing wire and apply color markings onto one side thereof at regular intervals. The other disc of the pair, which is longitudinally offset from the one disc, applies markings of the same color to the opposite side of the wire in registration with the markings applied by the one disc to form annular bands of the color on the wire at regularly spaced intervals. See H. L. Woellner U.S. Pat. No. 3,176,650. Such an arrangement has been found to be unsuitable for applying colorant to substantially all the surface of a plastic insulated wire.

In the application of colorant material to plastic insulated wire, difficulty has been encountered in controlling the shape and opacity of colored markings on the plastic insulated wire. Difficulty has been experienced where it is desirable or necessary to advance the insulated wire at a high rate of speed. As liquid colorant material is sprayed onto the insulated wire, generally at an angle of 90° to the path of travel of the insulated wire, the liquid colorant material could be accelerated instantaneously up to wire speed, thereby causing high impact at high wire speeds. The liquid may rebound off the wire, causing poor opacity.

Preferably, the sought after arrangement for applying a colorant material to substantially the entire peripheral surface of a plastic insulated wire is non-contacting. One reason for this relates to the kinds of plastic materials which comprise the extrudate that is applied to the wire. In today's world, fluoropolymers have been found to possess a number of desirable attributes. Accordingly, their use has proliferated. However, unlike some polyolefins such as polyvinyl chloride (PVC), for example, which are somewhat porous thereby allowing any colorant material to be applied to it either before or after it has been cooled, fluoropolymers generally are non-porous, necessitating application of colorant material thereto while in a hot state after extrusion but prior to cooling. Should a contact device be used immediately after the extrudate has been applied, it would result in widespread deformation of the plastic material.

Further of importance is the need to stabilize the moving wire against undulatory movement. Otherwise, the resulting coloring could be non-uniform. Also, undesired undulations could cause the moving colored wire to engage undesirably wire guides or other equipment.

Apparatus had been available in the marketplace for the surface coloring of insulated wires having a relatively large diameter-over-dielectric (DOD) and cables in line with an extruder, allowing the extrusion of plastic material in one basic color. Such a system involved a high pressure ink pump and three nozzles attached to a ring and spaced about the periphery of an elongated material which was advanced through the ring.

What is needed and what is not provided in the prior art are methods and apparatus for applying a colorant material to an elongated material having a relatively small cross section transverse to its longitudinal axis in a manner which allows the elongated material to be moved at a relatively high rate of speed. The sought after methods and apparatus should be capable of applying the colorant material in tandem with an extruder which applies plastic insulation material and the application of the colorant material to the surface of the insulation should be such that it covers substantially the entire surface thereof.

SUMMARY OF THE INVENTION

The foregoing problems of the prior art have been overcome by the methods and apparatus of this invention. In a method of coloring an elongated material, relative motion is caused to occur between the elongated material and a source of a colorant material in a direction along a longitudinal axis of the elongated material. Colorant material is directed in spray patterns toward the elongated material in such a manner that substantially all the surface area of the elongated material is covered therewith. A first plurality of the spray patterns is such that each spray thereof occupies only an area of a plane and is at a predetermined angle to the axis of the elongated material with the first plurality being disposed between a colorant supply head and a takeup. A second plurality of spray patterns may be disposed between the colorant supply head and a payoff. Each of the second plurality of spray patterns is fully conical. The first and the second pluralities of the spray patterns are arranged and spaced along the longitudinal axis of the elongated material.

An apparatus for coloring plastic insulation includes facilities for causing media means enclosed by plastic insulation to be moved along a path of travel. Spaced along the path of travel are nozzles which are arranged and spaced to direct colorant material from a source in spray patterns into engagement with the plastic insulation such that substantially all the surface area of the plastic insulation is covered with the colorant. A first plurality of the nozzles cause the spray patterns of colorant material from each to be disposed in a single planar area. A second plurality of the nozzles are such that they direct the spray patterns of colorant therefrom each in a conical pattern. The nozzles of each plurality are spaced along the path of travel and are directed in different radial directions toward the insulation. The first plurality of nozzles is disposed between a colorant supply head and a takeup whereas the second plurality is disposed between the colorant supply head and an extruder which applies the plastic insulation to the wire. Advantageously, the cooperation among the first plurality of nozzles and their longitudinal and circumferential spacing stabilizes substantially the moving plastic insulated media means against undesired undulations.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
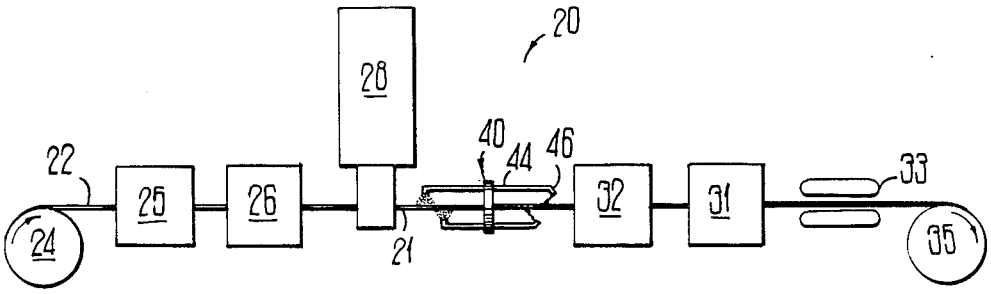
FIG. 1 is an overall schematic view of a manufacturing line for coloring plastic insulation on a moving conductor wire.
Figure 2:
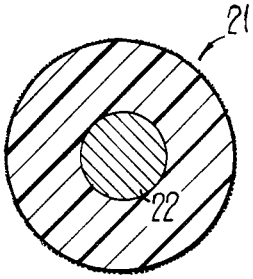
FIG. 2 is a cross sectional view of a metallic conductor, for example, which has been enclosed with plastic insulation material.

Referring now to FIG. 1, there is shown an overall schematic view of a manufacturing line 20 for providing a plastic insulated conductor wire 21 (see FIG. 2) and then for coloring the plastic. The description to follow is directed to the insulation and its subsequent coloring for a metallic conductor, but it should be understood that the methods and apparatus of this invention also could be used to color plastic insulation that has been applied to a moving elongated material such as optical fiber, for example.

A metallic conductor 22 is moved from a supply reel 24 and advanced through a drawing apparatus 25 wherein the diameter of the wire is reduced. Thereafter, it is annealed in an annealer 26, then cooled and reheated to a desired temperature after which is it moved into and through an extruder 28.

In the extruder 28, a plastic insulating material is applied to the moving wire to enclose it. Desirably, the insulating material is a clear or neutral color plastic such as a fluoropolymer or polyvinyl chloride (PVC) for example. The details of the structure of the drawing apparatus, annealer and extruder are all well known in the art and do not require elaboration herein. Afterwards, the plastic insulated wire is moved through a cooling trough 31 by a capstan 33 and onto a takeup 35. A conventional marking device 32 may be used to apply a band marking to the insulation.

Between the extruder 28 and the takeup 35, a colorant material is applied to the plastic insulated wire. The location along the line 20 where it is applied depends on the kind of plastic material comprising the extrudate. If the extrudate is a PVC, the colorant may be applied after the insulated wire is advanced out of the cooling trough 31, or before it enters the cooling trough. PVC exhibits porosity and even after it has been cooled, the colorant material will penetrate the insulation through the pores and hence provide a permanent coloring of the insulation. On the other hand, if the extrudate comprises a fluoropolymer, which is non-porous, the colorant material is applied at a location between the extruder 28 and the cooling trough 31.

Notwithstanding its location, a colorant material application apparatus 40 is included in the line 20 and is effective to apply a colorant material to substantially the entire surface area of the moving insulated conductor 21. Advantageously, the application apparatus 40 is a non-contact device. Preferably, the colorant material is an ink such as No. 3616, for example, available commercially from GEM Gravure Co. of West Hanover, Mass.

Figure 3:
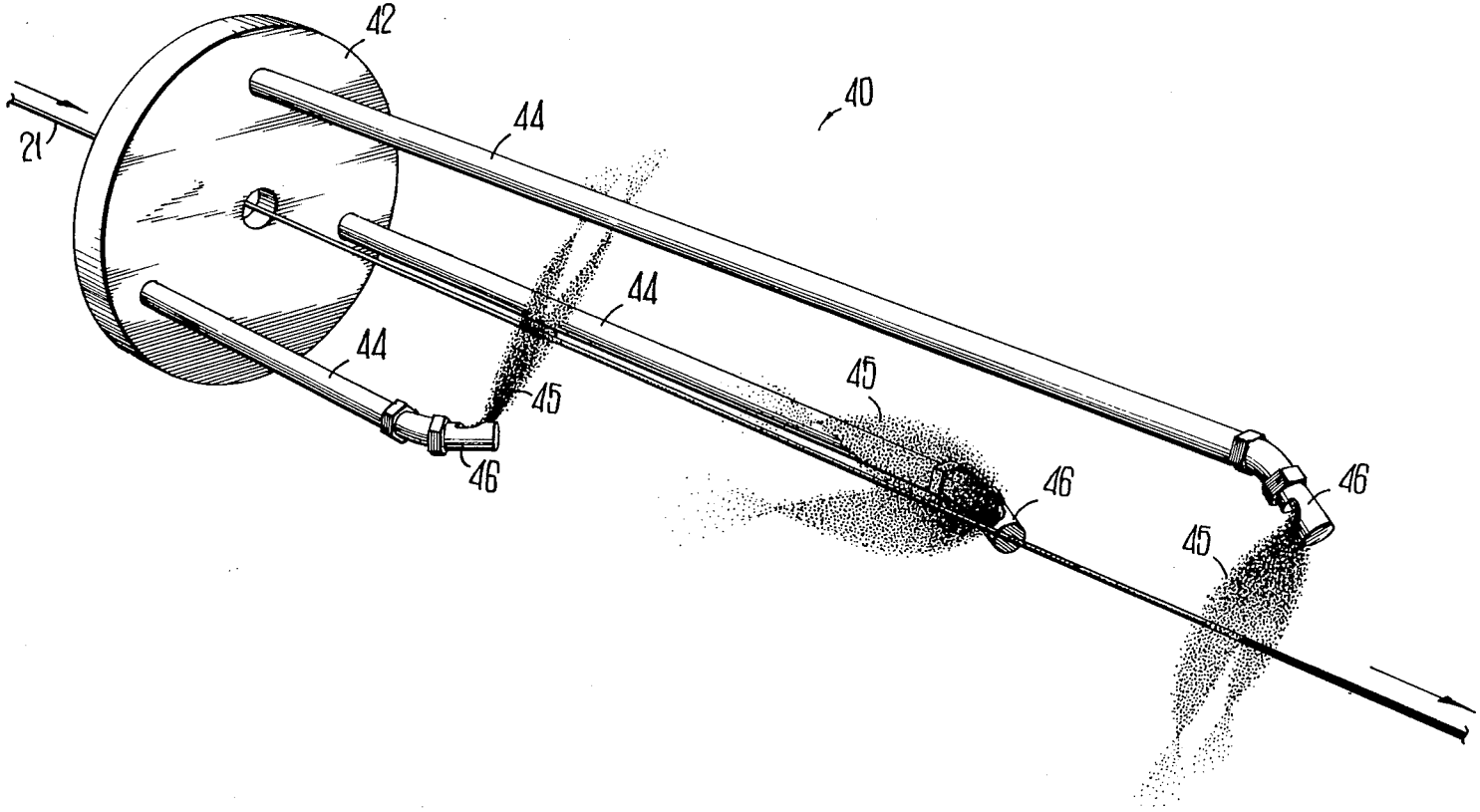
FIG. 3 is a perspective view of a portion of the manufacturing line of FIG. 1 and shows a plurality of nozzles which are used to apply a colorant material to the plastic insulation.

As can best be seen in FIG. 3, the apparatus 40 includes a manifold head 42 which is connected to a source of supply (not shown) of colorant material. The head 42 has an annular shape to allow the plastic insulated conductor to be advanced therethrough. Extending from one side of the manifold head 42 are a plurality of tubular support members 44—44 which are connected through the manifold head to the source of supply. Attached to each tubular member 44 is a nozzle 46 which has an entry port that communicates with the passageway through its associated tubular member.

Each nozzle 46 is one which is adapted to provide a particular spray pattern of the colorant. Preferably the nozzle 46 emits colorant material therefrom in a single plane or sheet 45 (see FIGS. 3 and 4).

Also, each nozzle 46 is positioned on its associated tubular member to emit its spray in a plane which is at a particular angle $\alpha$ (see FIG. 4) to the path of travel of the plastic insulated wire. The angle $\alpha$ is such that the spray has a component parallel to the path of travel of the insulated wire but in a direction opposite to the direction of movement of the insulated wire. Preferably, that angle $\alpha$ is in the range of about 135° to 135°. Because of the direction of the spray pattern, the velocity components tend to provide a smoothing action on the ink and thereby prevent excessive buildup. The result is a surface having a substantially uniform coating thereon.

Figure 4:
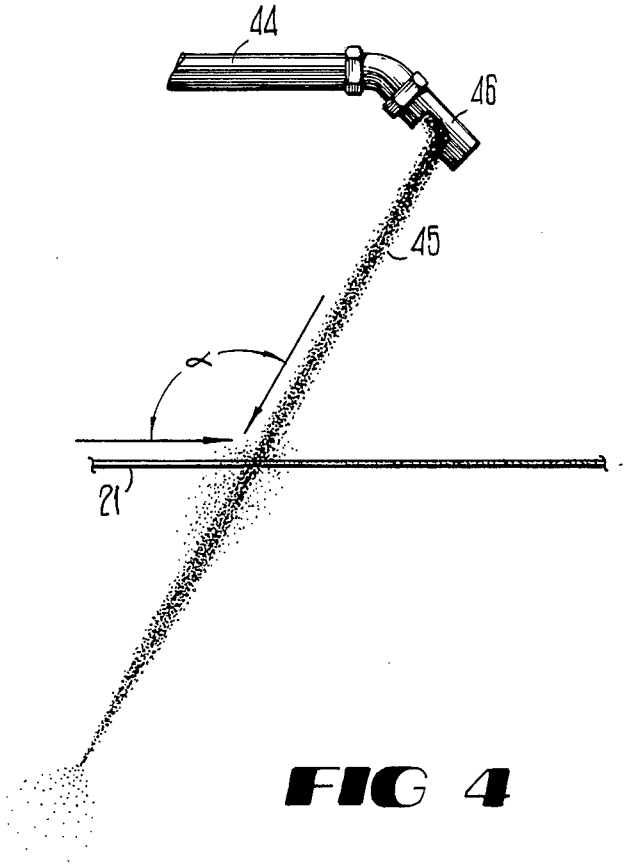
FIG. 4 is an enlarged view of one of the nozzles of FIG. 3.

It should be also observed that in addition to the predetermined angle at which the nozzles are disposed, there are other factors about their positions which are important (see again FIGS. 3 and 4). First, the nozzles are staggered along the path of travel of the plastic insulated wire. The staggered arrangement prevents interference among the spray patterns. Secondly, the nozzles are generally equiangularly spaced about the periphery of the plastic insulated wire. Thirdly, each of the nozzles is spaced about one half inch from the path of travel of the insulated wire. It has been found that as the distance increases beyond one half inch, less coverage of the plastic insulation with the ink is experienced.

Figure 5:
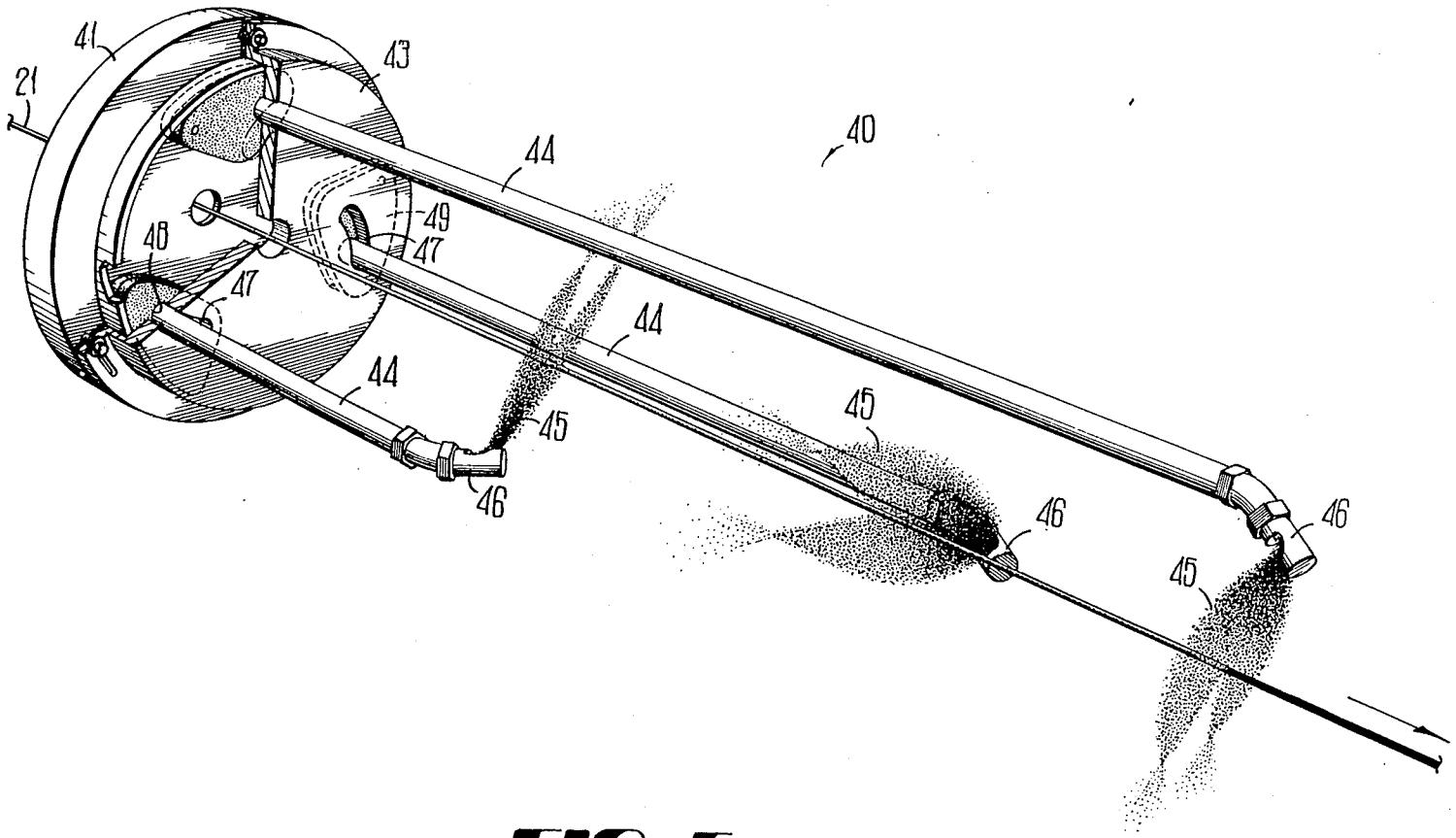
FIG. 5 is a perspective view of an arrangement which can be used to move the nozzles of FIG. 3 closer to or farther from the wire.
Figure 7:
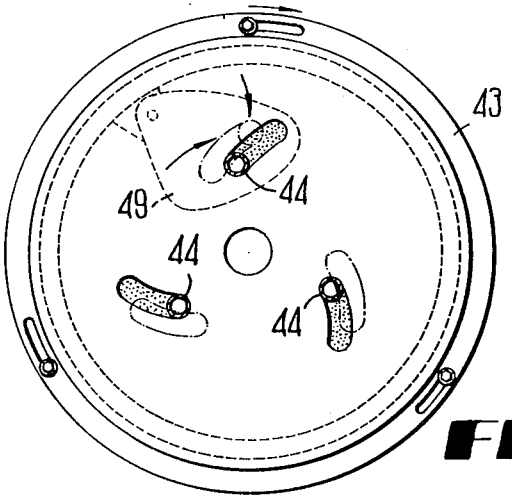
FIGS. 6 and 7 are elevational views of a portion of the arrangement of FIG. 5 for moving the nozzles closer to or farther away from the wire.
Figure 6:
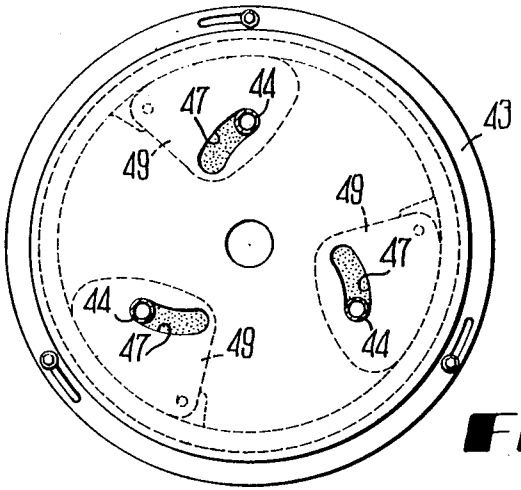

Movement of the nozzles toward or away from the insulated wire 21 may be accomplished with the arrangement shown in FIGS. 5-7. In the arrangement shown in FIGS. 5-7, the manifold head 42 may comprise a fixed annular member 41 which is connected to source of colorant material and a rotatable member 43. The rotatable member 43 is disposed adjacent to the fixed member 41 and includes a plurality of arcuate camming slots 47—47. Each tubular member 44 extends through an opening 48 in a pivotally movable sealing member 49 and through one of the slots 47—47. By turning the member 43, each tubular member is moved along its associated slot 47 in the member 43 and hence the nozzles are caused to be moved closer to or farther away from the insulated wire 21. The movement of the nozzles toward the path of travel of the insulated wire can be seen by viewing the sequence of FIGS. 6 and 7. Each pivotally mounted sealing member is a laminate comprising a sealing material and a backing material so that the member 43 creates a seal against the tube moving rotatable member 43. Also, the moveable member 43 is sealed along a peripheral edge surface that overlaps the fixed member 41.

The nozzles 46—46 also are advantageous from another standpoint. Important to the uniform coating of the plastic insulation is its improved stability against undesired undulations as it is advanced through the applicator apparatus. It has been found that because of the spray patterns emitted from the nozzles 46—46, the plastic insulated wire is substantially free of any undulations from its desired path.

It should be observed from the drawings that the nozzles 46—46 are disposed between the manifold head 42 and the takeup. It has been found that the coloring operation is enhanced by disposing a second plurality 51 of spray nozzles (see FIG. 8) between the manifold head 42 and the extruder 28. Each of the nozzles of the second plurality 51 is designated by the numeral 50.

Unlike the nozzles 46—46, each of the nozzles 50—50 provides a solid cone-shaped spray pattern 53 of the colorant material. Each nozzle 50 provides a uniform spray of medium to large size droplets. Such a nozzle is commercially available, for example, from the Spraying System Company of Wheaton, Illinois under the designation Full Jet® nozzle. Spray angles between opposed lines on the outer surface of the spray pattern may be in the range of from about 40° to about 110°.

Figure 8:
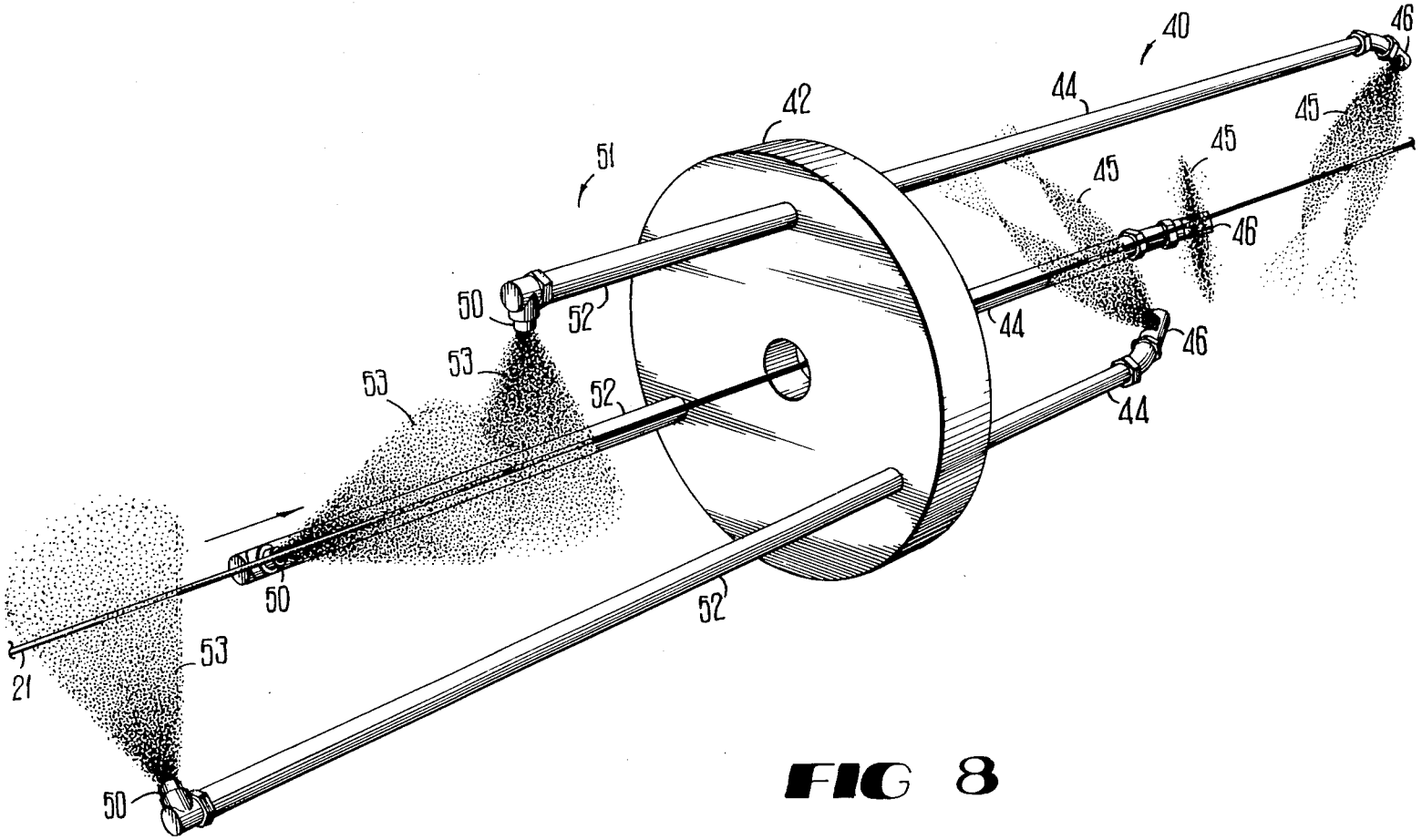
FIG. 8 is a perspective view of a preferred embodiment which includes first and second pluralities of spray nozzles.

Also as can be seen in FIG. 8, each nozzle 50 is supported from a tubular member 52 which projects from the manifold head 42. Colorant material provided to the head 42 is caused to flow through each of the tubular members 52—52 and to the nozzles 50—50.

The nozzles 50—50 are disposed to reduce interference among the spray patterns and to enhance the coverage of the colorant material on the surface of the plastic insulated wire. As can be seen in FIG. 8, the nozzles are staggered along the path of travel of the plastic insulated wire such that the spray patterns are spaced apart. Also, the nozzles 50—50 are arranged about the path of travel of the insulated wire so that each is directed in a different radial direction and preferably so that they are spaced equiangularly about the moving wire.

Although the nozzles 50—50 enhance the coverage of the surface area of the plastic insulation, they also tend to cause undulatory movement of the traveling insulated wire. However, this effect is muted by the nozzles 46—46 each of which provides a sheet spray.

A further advantage of the foregoing described arrangement is that it is capable of providing the colorant material at a relatively low pressure, e.g. in the range of about 3 pounds per square inch. Not only is such a low pressure system less expensive than one involving high pressure, but also it avoids an excessive amount of misting or atomizing. Should there be excessive misting or atomizing of the colorant material, the misted or atomized material would have to be condensed and recirculated which requires additional capital investment.

Figure 9:
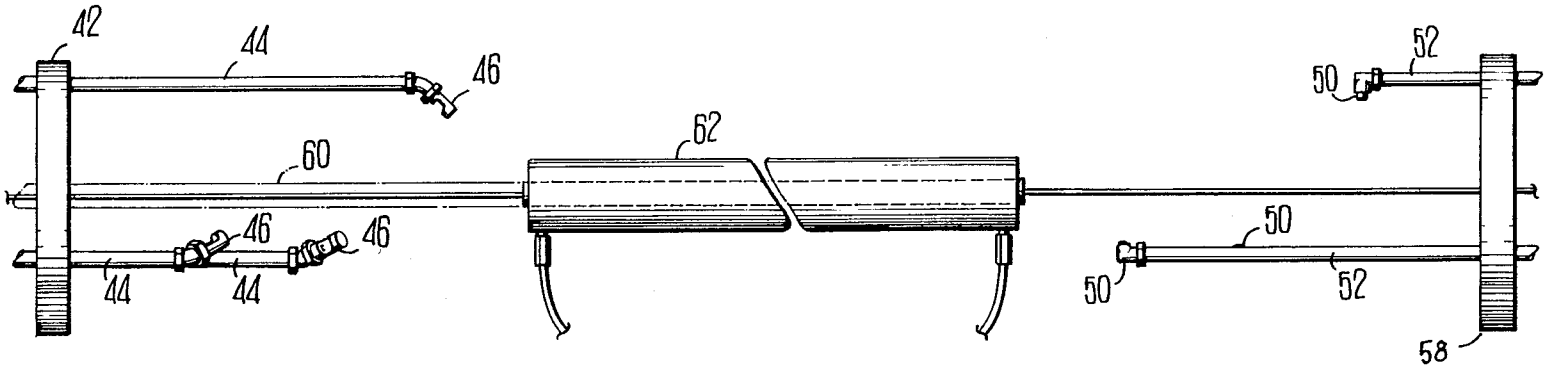
FIG. 9 is a view of a transition tube which is used for changing colors.

The system of this invention also includes facilities for affecting cutover from one colorant material to another as the insulated wire continues to be moved along the path of travel. A second manifold head 58 (see FIG. 9) identical to the manifold head 42 and having first and second pluralities of nozzles is provided. Further, a shroud 60 which is mounted for reciprocal movement by an air cylinder 62, for example, is interposed between the two manifold heads. The manifold head 58 is operative to supply colorant to its associated nozzles to coat the wire insulation. When it is desired to change colors, the flow of colorant material to the head 42 currently not in use is begun and the air cylinder is controlled to cause the shroud to be moved to the right as viewed in FIG. 9 to shield the moving insulated wire from the nozzles 46—46 and 50—50 of the head 58. The colorant material to the head 42 from which the shroud has been moved is sprayed by its associated nozzles onto the moving insulated wire. Shortly, afterwards, the flow of colorant material to the head 58 is discontinued.

Advantageously, the shroud arrangement may be used to facilitate the cleaning of the apparatus. When one of the heads 42 or 58 is not in use and its nozzles shrouded from the moving insulated wire 21, a cleaning liquid is flowed through the tubular members and nozzles of the unused head to clean them.

Figure 10:
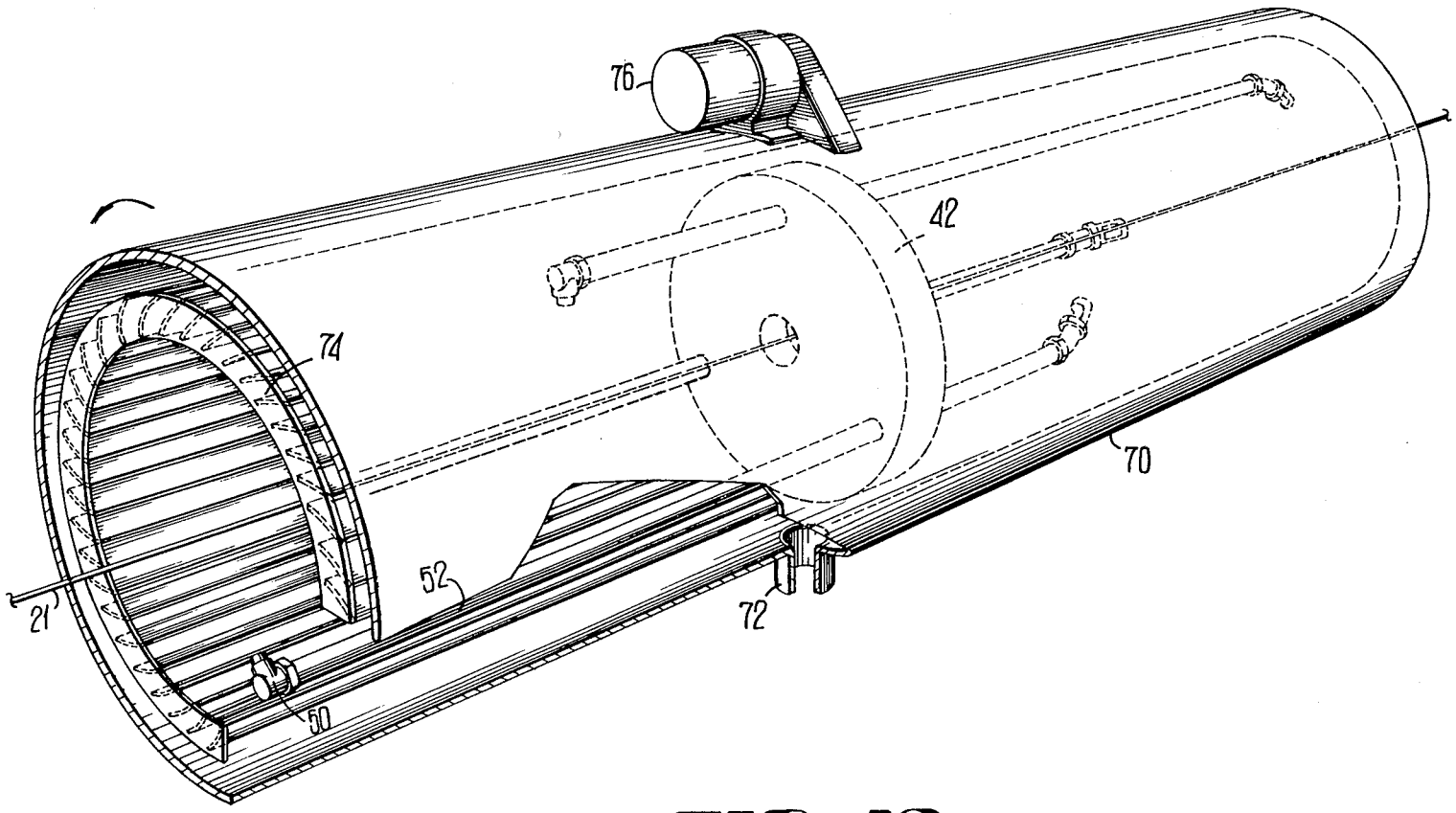
FIG. 10 is a view of a housing for containing excess coating material.

The system of this invention may also include provisions for avoiding splashback of the unused colorant material onto the insulated wire. As is seen in FIG. 10, the manifold head 42 may be enclosed in a housing 70 from a lower portion of which extends a drain 72. Within the housing is disposed a centrifugal fan 74 which is turned by a motor 76.

Advantageously, the rotation of the fan is such as to cause unused portions of the ink dispensed from the nozzles to be moved outwardly into engagement with an inner surface of the housing. The unused ink flows along the housing wall to the drain and thence to recirculating facilities for reuse. This arrangement prevents ink from rebounding from the housing and re-entering the coating area and onto the wire which could result in a non-uniform coating. Also, by reversing the direction of rotation of the fan, a cleaning medium is caused to be kept within the fan and about the nozzles and manifold head to clean thoroughly those portions of the apparatus.

It is to be understood that the above-described arrangements are simply illustrative of the invention. Other arrangements may be devised by those skilled in the art which will embody the principles of the invention and fall within the spirit and scope thereof.

What is claimed is:

1. A method of applying a coating material to the outer surface of an elongated material, said method comprising the steps of:

causing relative motion between the elongated material and a source of coating material along a path of travel in a direction parallel to the longitudinal axis of the elongated material by moving the elongated material along the path of travel; while directing each of a plurality of spray patterns of the coating material which comprise a first group toward the elongated material in such a manner that the coating material of each spray pattern of the first group is distributed in a generally conical configuration; and then directing each of a plurality of spray patterns of the coating material which comprise a second group toward the moving elongated material in such a manner that the coating material of each one of the spray patterns of the second group has a substantially planar distribution as the coating material of each spray pattern of the second group is directed into engagement with the elongated material and such that the direction of each of the spray patterns of the second group is at a predetermined angle to the path of travel with the direction of each of the spray patterns of the second group having a horizontal component in a direction opposite to the direction in which the elongated material is moved, the spray patterns of said second group being staggered along and spaced generally equangularly about the path of travel and cooperating to prevent unintended undulations of the moving elongated material as coating material is applied thereto, the second group being spaced from the first group in a direction along the path of travel.

2. The method of claim 1, wherein the distance between the point at which each spray pattern is emitted and the elongated material may be varied.

3. The method of claim 1, wherein colorant material is moved from a source into a manifold and distributed to each of a plurality of spray nozzles and said method further includes the steps of interposing a tube between the elongated material and the nozzles of the manifold and thereafter causing a colorant to be emitted from another manifold and directed toward the elongated material.

4. The method of claim 1, wherein the step of applying coating material includes the step of applying colorant material to a plastic material in tandem with the application of the plastic material to the elongated material.

5. The method of claim 4, wherein the plastic material is a fluoropolymer plastic insulation material.

6. The method of claim 1, wherein the elongated material is a plastic insulation material which has been extruded onto media transmission material and the coating material is a colorant material which is applied to the plastic insulation.

7. The method of claim 1 which is used to apply a colorant to a plastic insulation material in the making of an insulated conductor wherein media means is enclosed in the plastic insulation material, said method also including the steps of applying the plastic insulation material to the media means and taking up the colored, insulated media means.

8. An apparatus for applying a colorant material to a plastic insulation material which encloses an elongated material, said apparatus comprising:

moving means for advancing successive increments of length of an elongated material enclosed by a plastic insulation material along a path of travel;

a source of colorant material;

first spray means connected to said source for directing each of a plurality of spray patterns of the colorant material toward and into engagement with the plastic insulation, the distribution of the coating material of each of the spray patterns of said first spray means being in a generally conical shape; and second spray means connected to said source and positioned after said first spray means in the direction of movement of the elongated material along the path of travel for directing a plurality of spray patterns of the colorant material toward and into engagement with the plastic insulation, the spray patterns of said second spray means being staggered along the path of travel, spaced generally equiangularly about the moving elongated material and directed in different radial directions to the path of travel with the coating material of each of the spray patterns of said second spray means having a distribution which is substantially planar and being effective to stabilize the elongated material to prevent undulations of successive increments of length thereof as the colorant material is applied to the plastic insulation, each of said plurality of spray patterns of said second spray means being directed to have a horizontal component in a direction opposite to the direction of movement of the elongated material.

9. The apparatus of claim 8, wherein the plurality of spray patterns are applied by a first plurality of spray nozzles and a second plurality of spray nozzles, each of said first plurality being adapted to apply the colorant material substantially in a solid conical shape.

10. The apparatus of claim 9, wherein said spray means includes a manifold which is connected to said source and to which are connected said first and second pluralities of nozzles, said nozzles being mounted on means attached to said manifold in such a manner that said nozzles can be moved closer to or farther from the path of travel.

11. The apparatus of claim 10, wherein said manifold is a first manifold and wherein said apparatus also includes a second manifold being connected to a source of colorant material and having connected thereto first and second pluralities of nozzles which are identical to the nozzles of said first and second pluralities which are connected to said first manifold, said apparatus also including a tubular member adapted to be disposed selectively between the elongated material and the nozzles of said first manifold or between the elongated material and the nozzles of said second manifold to prevent the colorant material from one of said manifolds from being deposited on the plastic insulation material and to facilitate the application of colorant material from the other of said manifolds to the insulation material on the elongated material.

12. The apparatus of claim 8, which also includes housing means disposed about said spray means and means disposed within said housing means for causing excess colorant material to be moved outwardly from the plastic insulation material into engagement with said housing means.

13. The apparatus of claim 12, which also includes recirculation means connected to said housing means for accumulating and recirculating unused colorant material to said spray means.

* * * * *